United States Patent [19]

Burger

[11] Patent Number: 4,493,332

[45] Date of Patent: Jan. 15, 1985

[54] HAIR CLIP

[76] Inventor: Wolfgang Burger, Ritterstrasse 19, DE-3260 Rinteln 1, Fed. Rep. of Germany

[21] Appl. No.: 464,141

[22] Filed: Feb. 7, 1983

[30] Foreign Application Priority Data

Feb. 9, 1982 [DE] Fed. Rep. of Germany ... 8203375[U]

[51] Int. Cl.[3] ..... A45D 8/00

[52] U.S. Cl. ..... 132/46 A

[58] Field of Search ..... 132/46 R; 63/1, 2, 29 R

[56] References Cited

U.S. PATENT DOCUMENTS

| | | | |
|---|---|---|---|
| 712,727 | 11/1902 | Schaeffer | 132/48 R |
| 2,813,532 | 11/1957 | Lerner | 132/46 R |
| 3,633,592 | 1/1972 | Buglio | 132/48 R |

*Primary Examiner*—Gregory E. McNeill

*Attorney, Agent, or Firm*—Cushman, Darby & Cushman

[57] ABSTRACT

Nowadays, pieces of jewelry are not only worn on fingers, arms, and around the neck but also in the navel or on the toes. With this invention, a clip to be attached as a piece of jewelry to the pubic hair has been created for wearing in particular in nudist colonies. The pubic hair clip exhibits a set ornamental stone; between this stone and the retaining clip hidden behind it, the pubic hair can be clasped together.

6 Claims, 3 Drawing Figures

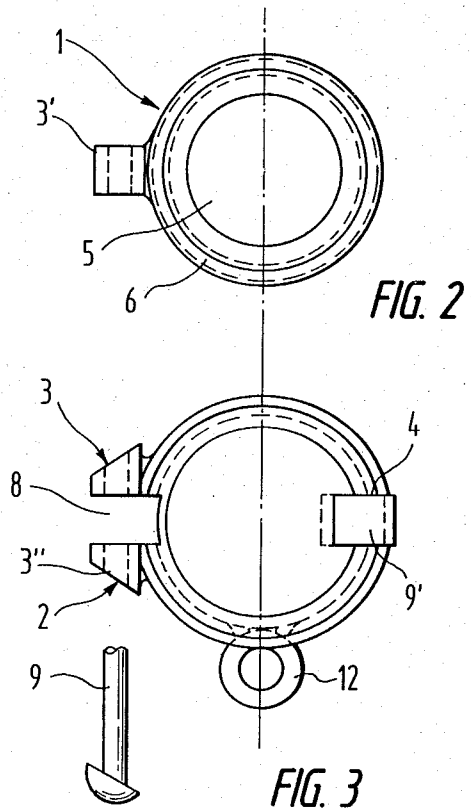
FIG. 2
FIG. 3
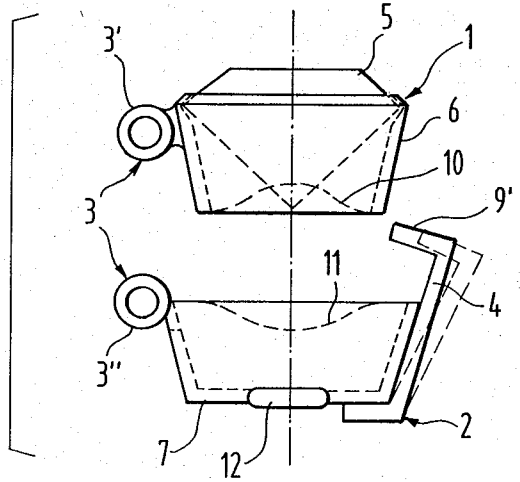
FIG. 1

HAIR CLIP

FIELD OF THE INVENTION

The subject of this invention is a hair clip.

BACKGROUND OF THE PRESENT INVENTION

As a rule, hair clips for use in the hair consist of an ornamental body in the form of a relatively flat or gently curved buckle onto which a retaining clip is hinged. The buckle is clamped to a strand of hair by pressing the strand of hair between the buckle and the retaining clip and then locking the retaining clip into position on the buckle.

The intention of this innovation is to create a hair clip which is not only suitable for wearing in the hair of the head but elsewhere on the body as well and especially in the pubic hair. The present invention does not have the function of the above described hair clip, to ensure that a strand of hair falls in a particular way, but rather its function is that of an ornament to be worn.

SUMMARY OF THE PRESENT INVENTION

The hair clip according to the present invention does not have the shape of a buckle but is comprised essentially of merely an ornamental stone or element in a setting which can be clamped to the hair by means of a retaining clip to which it is directly connected, the retaining clip being sized and shaped to receive the setting. In this way, the retaining clip is hidden behind the ornamental stone, thus ensuring that the hair clip when worn, is visually appealing since only the ornamental position remains visible.

Retention of the hair clip in hair is assured, regardless of the type of hair, if the hair passes between the ornamental body and the retaining clip and if desired, shaped areas in the two mating rims along the bottom of the setting and the top of the clip, can be provided to receive a quantity of hair. This is the case if, according to one advantageous further development of the present invention, the retaining clip is in essence shaped like a cup, with or without a bottom, into which the set ornamental stone nestles when the hair clip is closed.

Thus, the hair clip is a piece of jewelry which can be firmly affixed to the hair so as to be safely and reliably worn, yet easily removable without any problem. It should be particularly noted that the clasping mechanism is almost completely hidden to the eye when in place in the hair since the retaining clip is cup shaped and the upper rim of the retaining clip and the setting of the ornamental stone are essentially congruent.

Other objects, features, and characteristics of the present invention, as well as the methods and operation and functions of the related elements of the structure, and to the combination of parts and economies of manufacture, will become more apparent upon consideration of the following detailed description and the appended claims with reference to the accompanying drawings, all of which form a part of this specification, wherein like reference numerals designate corresponding parts in the various figures.

BRIEF DESCRIPTION OF THE DRAWINGS

The preferred exemplary embodiment can be understood with reference to the drawings in which:

FIG. 1 shows an expanded lateral view of the hair clip according to this innovation;

FIG. 2 shows a top view of the ornamental stone in this setting; and

FIG. 3 shows a top view of the retaining clip in the shape of a cup.

DETAILED DESCRIPTION OF THE PREFERRED EXEMPLARY EMBODIMENT OF THE PRESENT INVENTION

The hair clip is comprised of an ornamental body 1 and a retaining clip 2 which in this case are connected with each other by means of a hinged joint so that the two can move and are held together by means of a locking pin 4.

As shown in FIG. 1, the ornamental body 1 is comprised of a cut body of glass, mountain quartz or one of a wide variety of natural or man made precious stones 5, fixed in a setting 6 formed from a precious metal or from a variety of other materials including natural and synthetic materials, which tapers conically toward the bottom end. To one side of the upper rim of the setting 6, the central socket 3' of a three sectional hinged joint 3 is soldered. The setting 6 is deep enough so that the cone of the stone 5 (shown in dotted lines in FIG. 1) disappears essentially completely therein.

The retaining clip 2, formed from a material similar to the setting or from a complementary material, has the shape of a cup with an interior conical taper which corresponds to the exterior of setting 6. It is preferred to have the exterior of clip 2 also tapered but other shapes could be employed. In the example shown, the retaining clip 2 has a closed bottom 7. A socket 3'' is soldered to one side of the upper rim of the retaining clip 2. Socket 3'' is tapered along both end surfaces approximately tangentially to the upper rim of the retaining clip, the taper being essentially V-shaped and opening toward the side of clip 2. A dead center notch 8 in the socket 3'' houses the central socket 3' provided as part of the ornamental body 1, with a hinge pin 9 completing the connection with the hinged joint. Hinge pin 9 can also have ends that taper in a corresponding manner to the tapered end surfaces.

Looking pin 4 is fixed to the bottom 7 of retaining clip 2 opposite to the hinged joint 3. Locking pin 4 extends upward from the bottom 7 parallel to the conical side wall of retaining clip 2 and terminates at a hook component 9' which is bent back toward the inside. Locking pin 4 is preferably soldered to bottom 7 but other forms of attachment could also be employed. It is important that the connection permit movement of pin 4 from its locked position, shown in full lines in FIG. 1, to its released position, shown in dotted lines in FIG. 1. In its locked position, it retains the ornamental body 1 which is clamped into the retaining clip 4 by means of the hook part 9'. If a solder connection is used, the pin 4 will be swivelled plastically or elastically around the soldering spot on the bottom 7 when it is in the release position indicated by the broken lines.

Both along the bottom rim of setting 6 as well as on the upper rim of the retaining clip 2, hollows 10 and 11 may be provided which make it easier to guide the hair through which it is to be clamped between the ornamental body 1 and the retaining clip 2.

Finally, parallel to the bottom 7 a small metal loop 12 is soldered to the retaining clip 2 in order to make it possible to insert a neck chain, thus allowing the hair clip to be worn as a pendant as well.

The ornamental body and the retaining clip may also be held together by a device other than a hinged joint and a locking pin, for instance, by designing the ornamental body and the retaining clip as two components which are completely separated from each other and which can be locked into each other, e.g., by means of flexible tongues or which can be connected with each other by means of a safety clamp, a screwed pipe joint, or an adhesive bond. In order to ensure that the two parts cannot be lost individually, these can be joined together by means of a small chain.

In addition to precious metals, such as gold and silver, the materials to be used for constructing the hair clip can include various synthetics including plastic or other natural or manmade materials.

While the invention has been described in connection with what is presently considered to be the most practical and preferred embodiment, it is to be understood that the invention is not to be limtied to the disclosed embodiment, but on the contrary, is intended to cover various modifications and equivalent arrangements included within the spirit and scope of the appended claims, which scope is to be accorded the broadest interpretation so as to encompass all such modifications and equivalent structures.

What I claim is:

1. A hair clip for use as a hair ornament comprised of an ornamental stone or element in a setting means, a clip member which is directly connected to the setting means and being sized and shaped to essentially lie hidden behind the ornamental stone and means for removably securing said clip member to said setting means with a limited quantity of hair being retained therebetween wherein said clip member has a frusto-conical shape with tapered interior and exterior side walls and said setting means has a frusto-conical shape and is sized so as to fit within said clip member.

2. A hair clip as in claim 1 wherein said clip member having side walls that define a hollow interior and said setting means including means defining an outer shape complementary to the hollow interior of said clip member.

3. A hair clip as in claim 2 wherein the mating bottom of said setting means and top of said clip member include means defining hollowed portions for receiving hair therein.

4. A hair clip as in claim 2 wherein said securing means comprises a hinge, said hinge having first and second portions respectively secured to said setting means and said clip member and a retaining pin for holding said first and second portions together.

5. A hair clip as in claim 4 further including a locking means to hold said setting means and clip member together; said locking means being secured to the exterior of said clip member at a point diametrically opposed to said securing means.

6. A hair clip as in claim 5 further including means defining a loop member secured to the exterior of said clip member at a point substantially equivalent between said hinge and said locking means.

* * * * *